United States Patent [19]

Sigmon

[11] Patent Number: 4,488,768

[45] Date of Patent: Dec. 18, 1984

[54] PROGRAMMABLE ELECTRICAL CONNECTOR

[75] Inventor: Ned A. Sigmon, Clemmons, N.C.

[73] Assignee: AMP Incorporated, Harrisburg, Pa.

[21] Appl. No.: 470,347

[22] Filed: Feb. 28, 1983

[51] Int. Cl.[3] ..... H01R 23/04; H01R 29/00

[52] U.S. Cl. ..... 339/99 R; 339/31 R; 339/103 M

[58] Field of Search ..... 339/17 F, 97 R, 97 P, 339/97 L, 97 C, 98, 99 R, 175 R, 175 C, 176 MF, 18 R, 18 P, 31 R, 31 M, 103 M

[56] References Cited

U.S. PATENT DOCUMENTS

| | | | |
|---|---|---|---|
| 3,235,833 | 2/1966 | Elm | 339/97 P |
| 3,573,708 | 4/1971 | Yarrick | 339/18 |
| 3,760,334 | 9/1973 | Bridle | 339/99 R |
| 4,221,445 | 9/1980 | Fleishhacker et al. | 339/18 R |
| 4,260,209 | 4/1981 | Zell | 339/14 R |
| 4,315,662 | 2/1982 | Greenwood | 339/97 C |

FOREIGN PATENT DOCUMENTS

| | | | |
|---|---|---|---|
| 2031215 | 12/1971 | Fed. Rep. of Germany . | |
| 2409311 | 12/1974 | Fed. Rep. of Germany .... | 339/99 R |
| 2122652 | 9/1972 | France . | |
| 366872 | 3/1963 | Switzerland . | |
| 1063596 | 3/1967 | United Kingdom . | |

*Primary Examiner*—Neil Abrams

*Attorney, Agent, or Firm*—R. W. J. Usher

[57] ABSTRACT

An electrical connector (11) in which an insulating housing body (12) is provided with a series of longitudinally extending compartments (15) adapted to receive terminals (14) in different longitudinal positions at a wire connecting face (17) to provide various alternative connection points to a series of wires (49). The terminals (14) comprise wire connecting portions (41) integrally joined by intermediate portions (43) of different lengths to contact portions (42). The connector (11) can be in kit form comprising the insulating housing, a group of such terminals (14) and a cover (13) for the wire connecting face (17) enabling different connection prints to be programmed.

11 Claims, 8 Drawing Figures

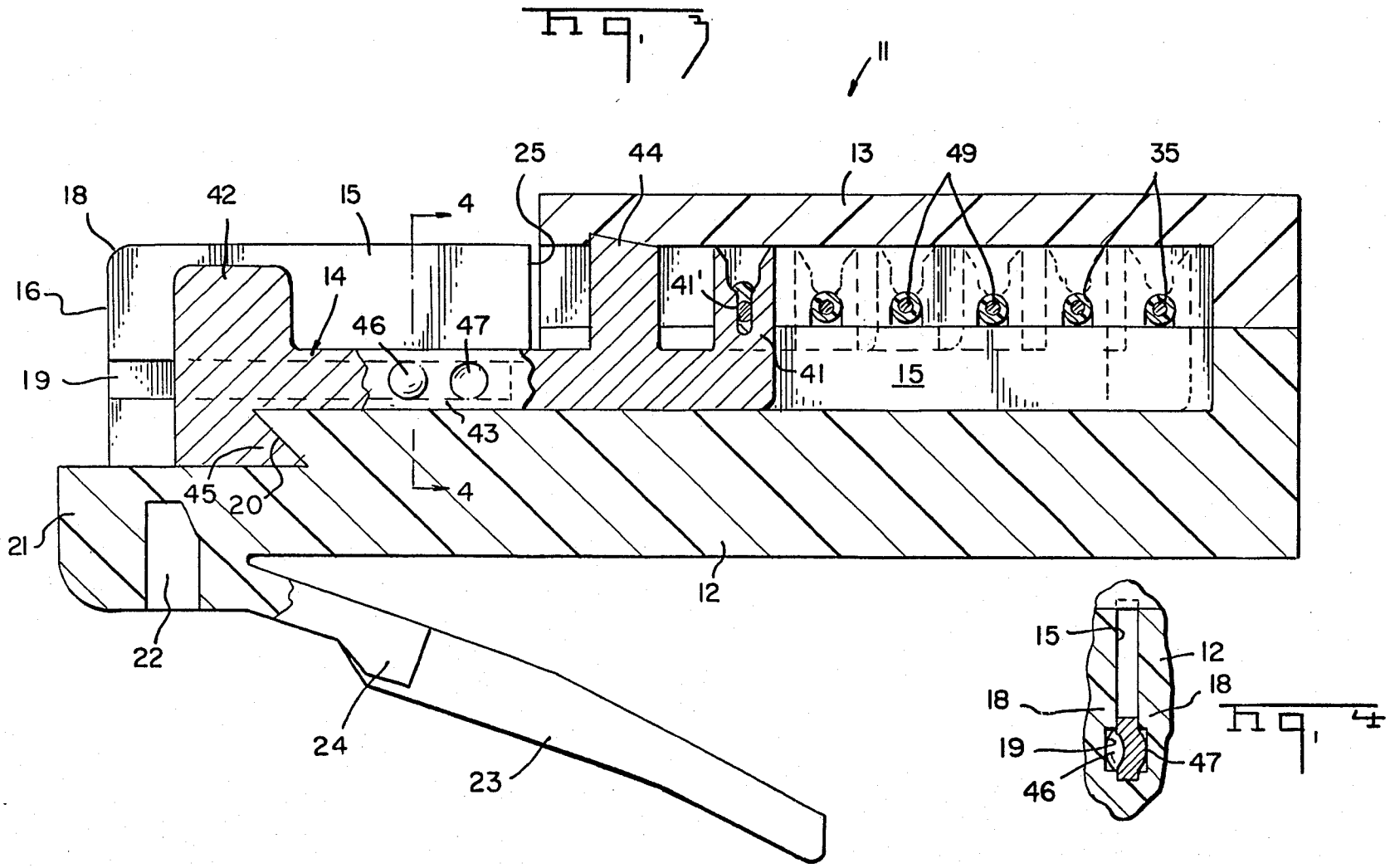
11
35
49
13
15
41
41'
44
25
12
4
47
43
46
14
42
18
16
19
20
45
21
22
23
24
12
18
47
15
18
19
46
4

PROGRAMMABLE ELECTRICAL CONNECTOR

The invention relates to an electrical connector and particularly to an electrical connector that can be programmed in the field to provide alternative wire connection points.

The invention also relates to a kit for making such connector.

According to one aspect of the invention, there is provided an electrical connector comprising an insulating housing body having a wire connecting face and a contact face, a series of terminal-receiving compartments extending longitudinally in side-by-side relation between the wire connecting face and the contact face, and a group of terminals, each having a wire connecting portion and a contact portion integrally joined by an intermediate portion, the intermediate portions being of mutually different lengths so that the terminals are selectively receivable in respective different compartments with the contact portions located at the contact face and the wire connecting portions located at the wire connecting face in staggered relation to provide various alternative wire connection points.

Preferably, the terminal-receiving compartments comprise slots opening to one end of the housing body. Terminals may be therefore loaded into the connector simply by movement into the open end along a longitudinal axis either manually or by using a relatively simple stitching machine.

Desirably, the wire connecting portions comprise wire-receiving slots and the connector also comprises a cover member moulded from insulating material having a wire engaging face formed with a series of wire stuffers arranged in matrix array corresponding with the various wire connection points, means being provided to retain the cover member on the housing body with the stuffers in stuffing engagement with respective wires.

The connector may be supplied as a kit including the base, cover and a group of terminals of different lengths in strip-form or loose piece.

According to another aspect of the invention, there is provided an electrical connector assembly comprising an insulating housing having a series of terminal-receiving compartments extending longitudinally in side-by-side relation across a wire-connecting face of the housing and a group of terminals having wire connecting portions receivable in various different longitudinal positions in each compartment to permit preselected alternative wire connection points.

A particular application of the invention is to effect the transition from a wire pair distribution in a flat telephone cable consistent with minimum cross-talk requirements to the distribution required in an FCC interface without a need for wire crossovers and rearrangements.

Examples of an electrical connector according to the invention will now be described with reference to the accompanying drawings in which:

FIG. 3 is a cross-sectional view along line 3—3 of FIG. 2;

FIG. 4 is a fragmentary view along line 4—4 of FIG. 3;

FIG. 5 is an exploded perspective view of the first example of the connector;

Figure 1:
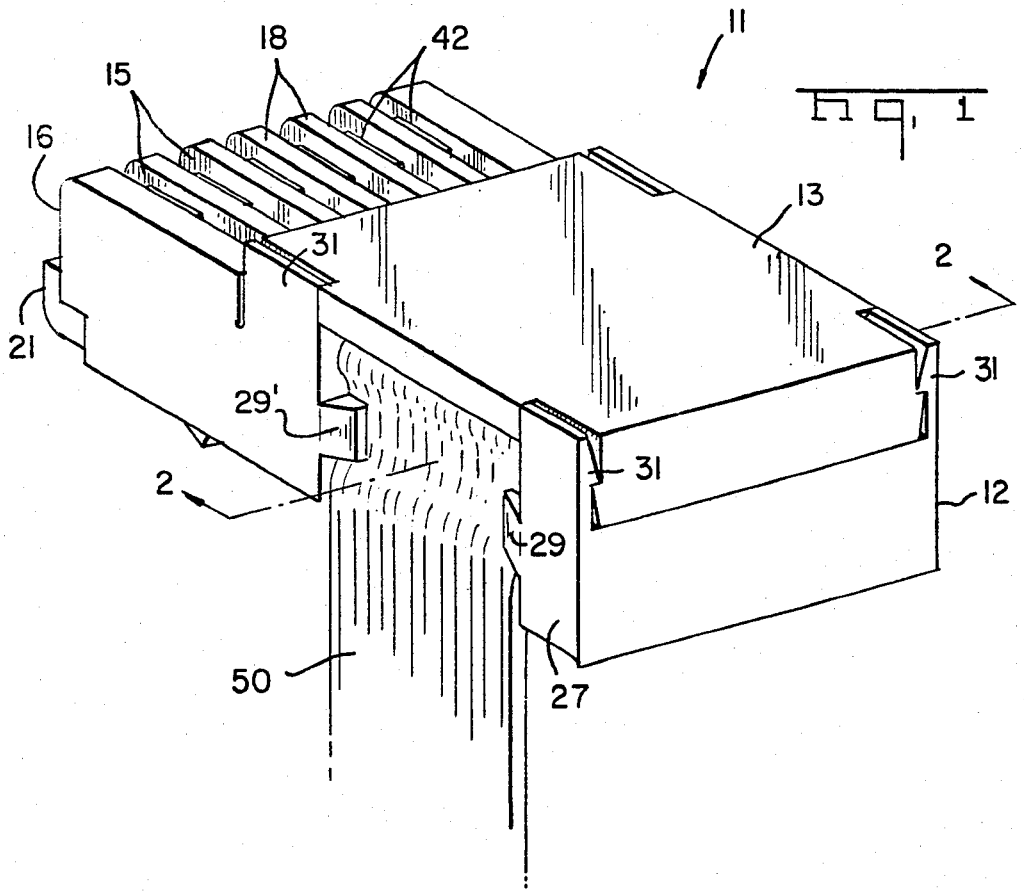
FIG. 1 is a perspective view of a first example of the connector assembled to a flat cable.
Figure 2:
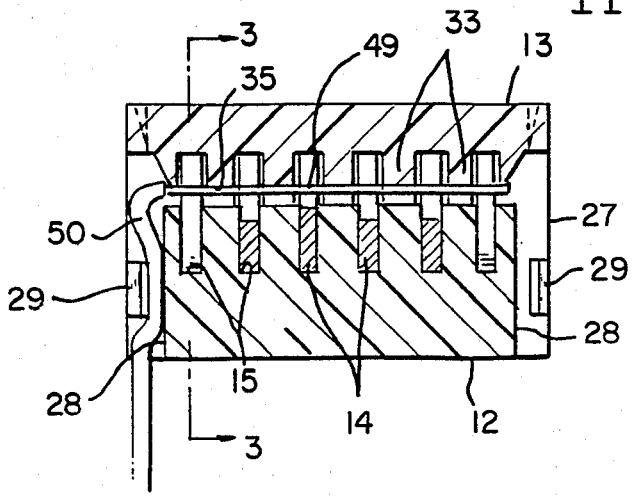
FIG. 2 is a cross-sectional view along line 2—2 of FIG. 1.
Figure 1:
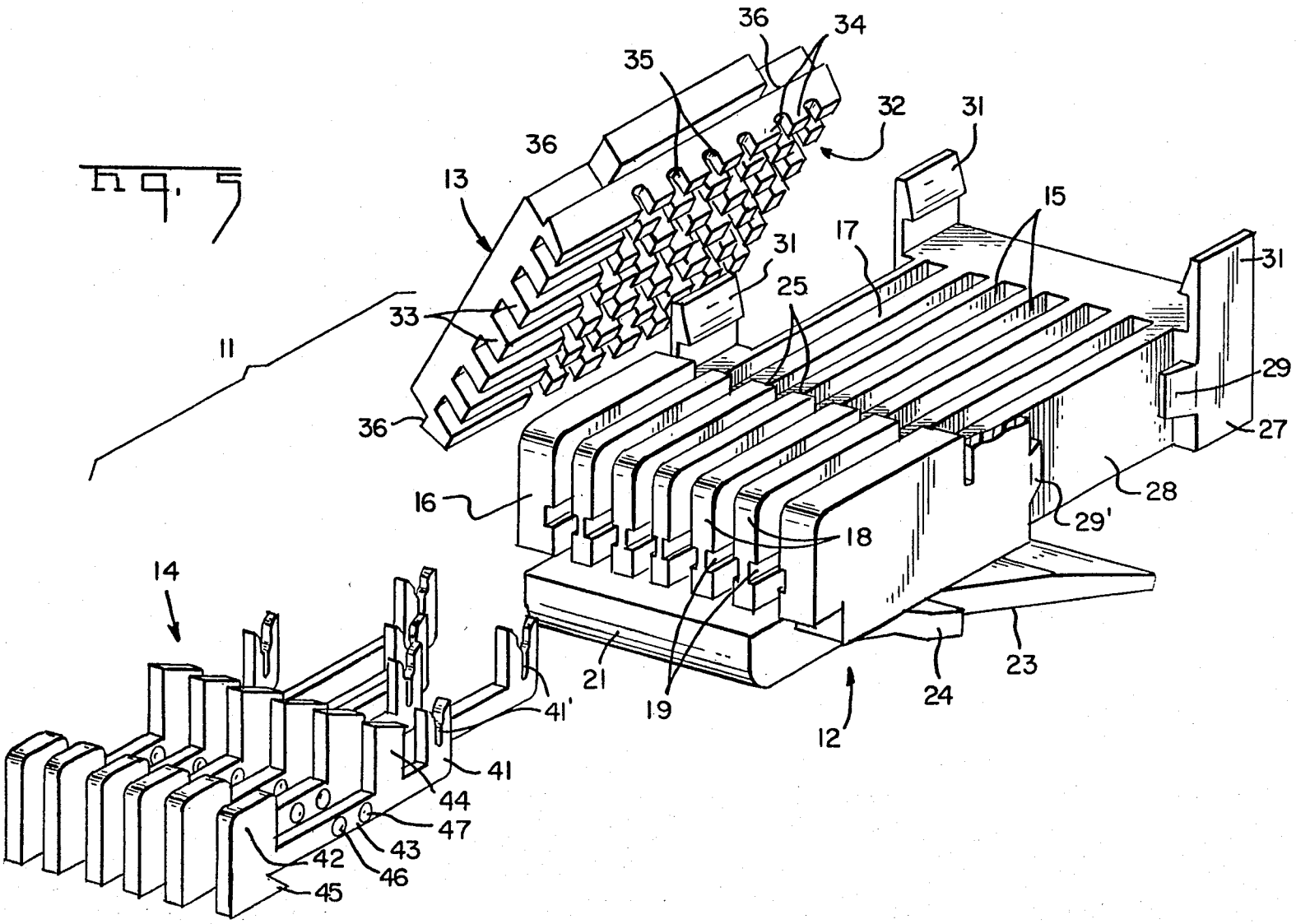

As shown particularly in FIGS. 3 and 5, the first example of connector 11 comprises a housing body 12, a cover 13 for attachment to the body and a group of stamped and formed terminals 14.

The body 12 is moulded in one piece from suitable plastics material as a generally rectangular block dimensioned for use as a standard modular telephone plug. A series of slot-form, terminal receiving compartments 15 extend in parallel relation between a contact face 16 of the body and a wire connecting face 17. The compartments are open at upper ends to the wire connecting face and at one longitudinal end to the contact face. Walls 18 defining the compartments are stepped at 25 so that the compartments are of reduced height at the wire connecting face. Opposite faces of walls 18 defining the compartments are formed adjacent the contact face with pairs of opposed longitudinally extending grooves 19 opening to the contact face and having a blind end adjacent the wire connecting face.

A base wall of the compartments is formed adjacent the contact face with an undercut terminal locating step 20 and extends beyond the ends of the compartments to provide a projecting lip 21. A locating recess 22 extends transversely of the underside of the lip from which a resilient finger piece 23 having a latching detent 24 extends rearwardly in known fashion enabling the plug to be latched and released manually from a telephone jack.

A flat cable-receiving recess 28 is formed in a face 27 of the body adjacent and transverse to the wire-connecting face and resilient cable gripping fingers 29 extend from respective opposite sides of the recess. Resilient latch arms 31, upstand from respective opposite corners of the wire connecting face.

The cover 13 is moulded in one piece from plastics material in generally rectangular plan. A wire connecting side 32 of the cover is formed with a series of parallel ribs 33 spaced apart at the same pitch as the compartment walls 18, portions 34 of the ribs extending across a wire connecting portion being castellated to provide a series of wire stuffers formed with a series of transversely aligned wire admitting notches 35. Thus, the notched stuffers are arranged in matrix array so that a wire admitting notch is adjacent each of the various wire connection points obtainable in all possible combinations of terminal loading in the housing. Latching shoulders 36 are formed at the ends of respective opposite longitudinal sides between which are laterally extending finger pieces 31 to facilitate application and removal of the cover.

Figure 6:
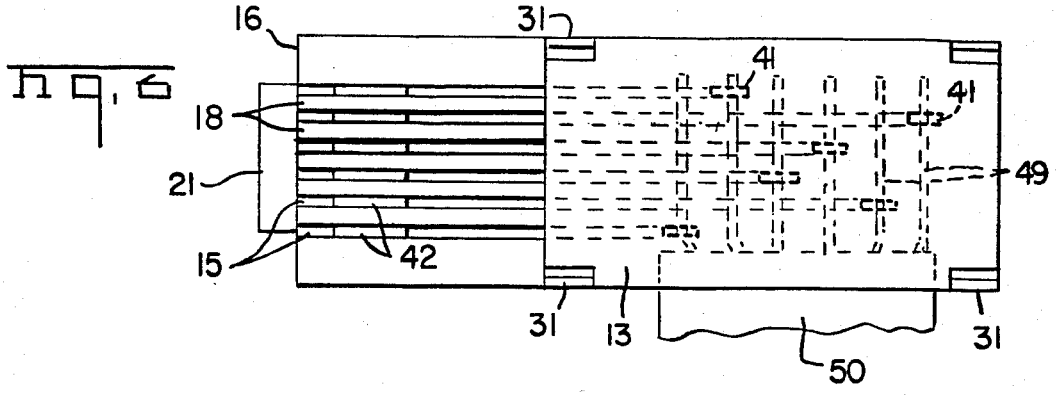
FIG. 6 is a plan view of the first example of the connector.

Each terminal 14 comprises a wire connecting portion 41 and a contact portion 42 integrally joined together by a strip-like intermediate portion 43. Anchoring portions 44 and 45 upstand from the intermediate portion and depend from the contact portion respectively, for engagement with the cover 13 and step 20. Terminal locating protuberances 46 and 47 are pushed out from respective opposite sides of the intermediate portion at longitudinally spaced locations in alignment with a pair of opposed grooves 19. The intermediate portions 43 of a group of terminals loaded into a single connector are normally all of different length to provide staggered wire connecting portions whilst the locating protuberances 46 and 47 and the anchoring portion 44 are each spaced the same distance from the anchoring portions 45. It should be noted that, when manufactured in strip form as shown in FIG. 6, the carrier strip 48 provides the precursor 44' of the anchoring portions 44.

The connector is assembled by stitching individual terminals of groups of terminals having intermediate portions of different length into preselected compartments so that the wire connecting slots extend towards the wire connecting face in longitudinally staggered relation. The terminals are retained in position prior to connection to the cable by engagement of the anchoring portion 45 with the undercut step 20 and by the receipt of the convex protuberances in the locating grooves 19.

The individual insulated wires 49 of a flat cable 50 are separated and located on the wire connecting face between the latch posts 31 and 32 so that the individual wires 49 (which may be flat conductors) extend transversely of the terminals. The cover is then pressed down on the body so that the notches 35 admit respective wires on each side of an aligned wire connecting portion 41 to press the wires into the respective slots 41. During application of the cover to the base, the latching posts resile until the cover inserts wires fully into the slots when the latching heads of the posts engage the shoulders 36 in a snap action to secure the cover to the base. The trailing cable is subsequently bent through 90° and received under the locating fingers 29 with a snap action to provide strain relief as shown in FIG. 1. Engagement of the anchoring portions 44 with the cover as shown in FIG. 3 assists in retaining the terminals in the housing.

Alternatively, the individual insulated wires may be located in the notches 35 prior to application to the base.

When assembled with the cable, the plug may be mated with a standard telephone jack.

The cover and body and a group of terminals having intermediate portions of different lengths, may be supplied in kit form for assembly in the field to enable the terminals to be tapped to wires in any desired combination.

It will be appreciated that the connector is therefore extremely versatile.

Figure 8:
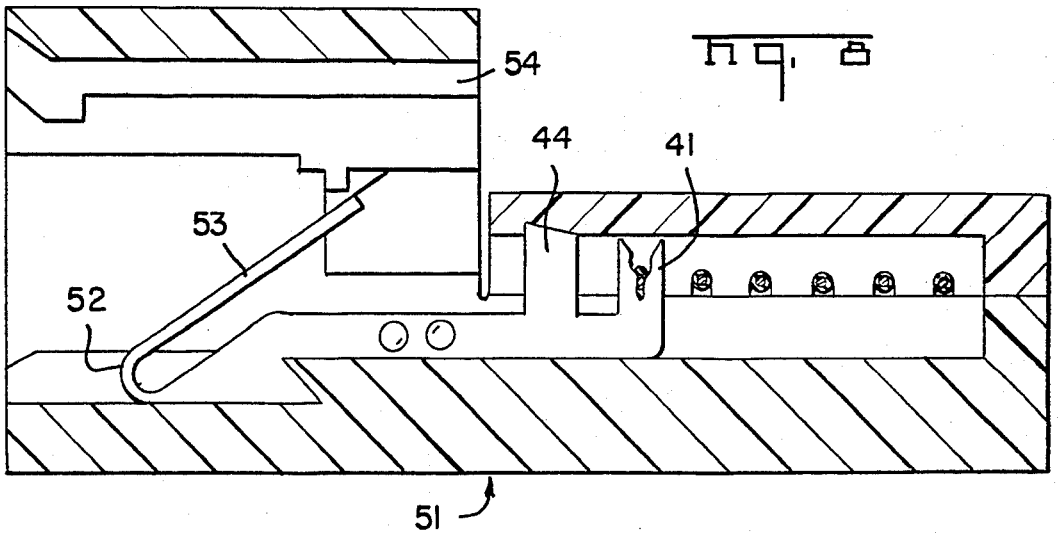
Figure 7:
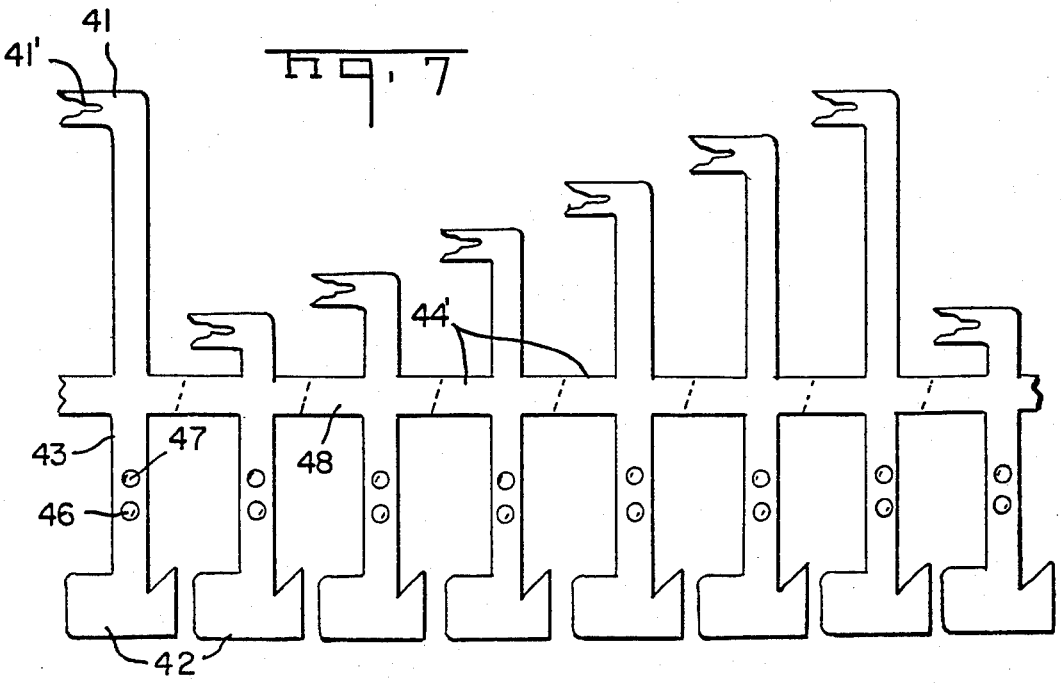
FIG. 7 is a plan view of a strip of terminals for the first example of the connector; and, FIG. 8 is a cross-sectional view of an alternative example of the connector according to the invention.

An alternative example of connector 51 shown in FIG. 8, is similar to the connector described above except that the contact portion is stamped as a spring arm 52 having a root end integral with an anchoring portion 45' and curving back so that a free end 53 extends away from the contact face.

A housing part adjacent the contact face is formed as a receptacle 54 surrounding the contact portion so that the connector functions as a jack for receiving a standard modular telephone plug.

I claim:

1. An electrical connector for use with laterally spaced wires, said connector comprising an insulating housing body having a wire connecting face at which said laterally spaced wires are to be positioned and a contact face, a series of terminal-receiving compartments extending longitudinally in side-by-side relation between the wire connecting face and the contact face, and a group of terminals, each having a wire connecting portion and a contact portion integrally joined by an intermediate portion, the respective intermediate portions being of mutually different lengths so that the terminals are selectively receivable in different compartments with the contact portions located at the contact face and the wire connecting portions located at the wire connecting face in staggered relation to provide various alternative wire connection points a different one of said wires being connected to the terminal located in any one of said compartments depending on which one of said different length terminals is received therein.

2. An electrical connector according to claim 1 in which the terminal-receiving compartments comprise slots opening to one end of the housing body.

3. An electrical connector according to claim 1 in which means are provided on the housing body to locate a flat cable extending in a plane transverse to the terminal-receiving compartments with the conductors of the cable aligned with respective wire connecting portions.

4. An electrical connector according to claim 3 in which the cable locating means comprise resilient cable gripping fingers extending in spaced relation from a face of the housing body extending transversely of and adjacent the wire connecting face to locate the cable in engagement with the housing body and extending in a plane transverse to the wire connecting face.

5. An electrical connector according to claim 1 in which the wire connecting portions comprise wire-receiving slots.

6. An electrical connector according to claim 5 including a cover member moulded from insulating material and having a wire engaging face formed with a series of wire stuffers arranged in matrix array so that a stuffer is adjacent each of the various wire connection points, means being provided to retain the cover member on the housing body with the stuffers in stuffing engagement with respective wires.

7. An electrical connector according to claim 6 in which the retention means comprises resilient latching means on the cover and base interengageable with a snap action on applying the cover to the base to stuff wires into respective terminals.

8. An electrical connector according to claim 2 in which the compartments comprise closely spaced walls formed with longitudinal grooves opening to the one end and the terminals are provided with longitudinally spaced convex protuberances pushed out from respective opposite sides adjacent the contact portion for receipt in the grooves in an interference fit.

9. A kit for making an electrical connector for use with laterally spaced wires, said connector comprising an insulating housing body having a wire connecting face at which said laterally spaced wires are to be positioned and a contact face, a series of terminal-receiving compartments extending longitudinally in side-by-side relation between the wire connecting face and the contact face, and a group of terminals, each having a wire connecting portion and a contact portion integrally joined by an intermediate portion, the respective intermediate portions being of mutually different lengths so that the terminals are selectively receivable in different compartments with the contact portions located at the contact face and the wire connecting portions located at the wire connecting face in staggered relation to provide various alternative wire connection points a different one of said wires being connected to the terminal located in any of said compartments depending on which one of said different length terminals is received therein.

10. A kit according to claim 9 in which the terminal-receiving compartments comprise slots opening to one end of the housing body.

11. A kit according to claim 9 in which the wire connecting portions comprise wire-receiving slots.

* * * * *